US006305562B1

(12) United States Patent
Chan et al.

(10) Patent No.: US 6,305,562 B1
(45) **Date of Patent: *Oct. 23, 2001**

(54) NURSING BOTTLE WITH GRIPPING RECESSES

(75) Inventors: Edwin Chan, Brooklyn, NY (US); Mari H. Ando, Stamford, CT (US); Thomas M. Dair, Yorktown Heights, NY (US)

(73) Assignee: Johnson & Johnson Consumer Products, Inc., Skillman, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/695,357

(22) Filed: Aug. 9, 1996

(51) Int. Cl.[7] ..... A61J 9/00
(52) U.S. Cl. ..... 215/11.1; 215/384
(58) Field of Search ..... 215/11.1, 11.4, 215/11.5, 384

(56) References Cited

U.S. PATENT DOCUMENTS

| | | | | |
|---|---|---|---|---|
| D. 226,688 | | 4/1973 | Thornton | D24/197 |
| D. 249,076 | * | 8/1978 | Meeker et al. | 215/11.1 X |
| D. 286,911 | | 11/1986 | Campbell et al. | D24/47 |
| D. 309,781 | | 8/1990 | Sharon et al. | D24/47 |
| D. 311,063 | | 10/1990 | Stephenson | D24/47 |
| D. 316,754 | | 5/1991 | Lau | D24/47 |
| D. 321,936 | | 11/1991 | Donovan | D24/197 |
| D. 376,430 | | 12/1996 | Humphrey et al. | D24/197 |
| D. 382,968 | | 8/1997 | Giles | D24/197 |
| 438,937 | * | 10/1890 | McKinnon | 215/11.1 |
| 2,469,489 | | 5/1949 | Allen et al. . | |
| 2,514,744 | | 7/1950 | Cipyak | 215/11.1 |
| 2,789,002 | | 4/1957 | Nicholas | 215/11.1 X |
| 2,793,778 | | 5/1957 | Maxwell . | |
| 2,831,596 | * | 4/1958 | Eyles | 215/11.1 |
| 2,986,296 | | 5/1961 | Bannister et al. . | |
| 3,145,867 | * | 8/1964 | Roberts et al. | 215/11.1 |
| 3,443,710 | | 5/1969 | Hills . | |
| 3,746,198 | | 7/1973 | Howland . | |
| 4,570,808 | * | 2/1986 | Campbell et al. | 215/11.1 |
| 4,676,387 | * | 6/1987 | Stephenson et al. | 215/11.1 |
| 4,700,856 | * | 10/1987 | Campbell et al. | 215/11.1 X |
| 4,750,630 | | 6/1988 | Campbell et al. . | |
| 4,813,556 | * | 3/1989 | Lawrence | 215/11.1 X |
| 4,832,213 | * | 5/1989 | Sharon et al. | 215/11.1 |
| 4,867,325 | * | 9/1989 | Dransfield | 215/11.6 X |
| 4,940,151 | | 7/1990 | Fett | 215/11.1 |
| 4,941,579 | | 7/1990 | Lee | 215/11.1 |
| 5,024,341 | | 6/1991 | Dekerle | 215/11.1 |
| 5,145,077 | | 9/1992 | Rohrig | 215/11.1 |
| 5,215,203 | * | 6/1993 | Malcolm | 215/11.1 |

FOREIGN PATENT DOCUMENTS

| | | | | |
|---|---|---|---|---|
| 197802 | | 2/1978 | (CH) . | |
| 595835 | * | 2/1978 | (CH) | 215/11.1 |
| 126921 | | 7/1928 | (DE) . | |
| 2 255 913A | | 11/1992 | (GB) . | |
| 2255913 | * | 11/1992 | (GB) | 215/11.1 |

* cited by examiner

*Primary Examiner*—Sue A. Weaver

(57) ABSTRACT

Nursing bottle providing improved ease of gripping during use has a first depression in its front surface for receiving an infant's fingers and a second depression on its back surface for receiving an infant's thumbs. Preferably, the first and second depressions are displaced longitudinally with respect to one another.

18 Claims, 18 Drawing Sheets

FIG. 12
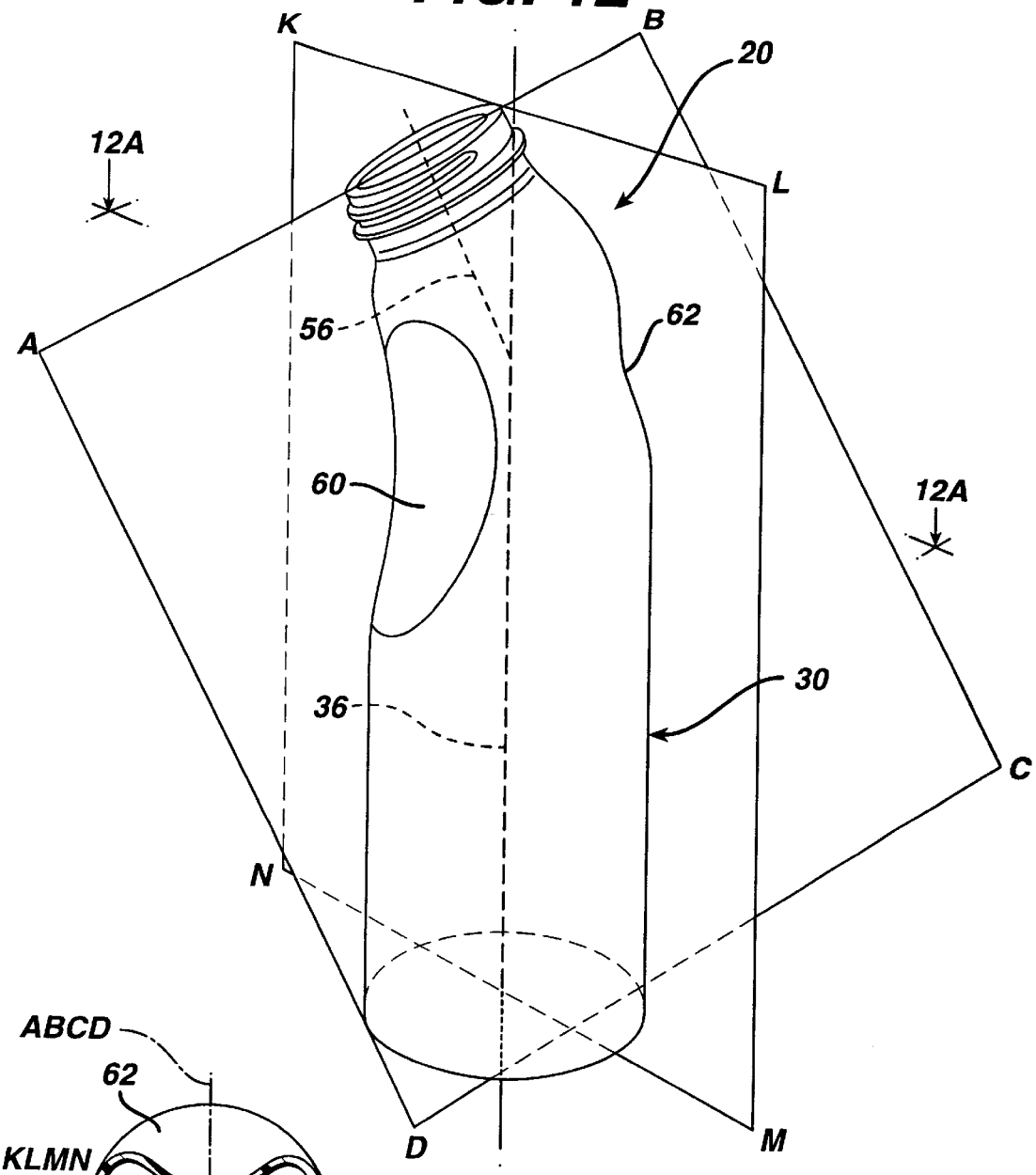
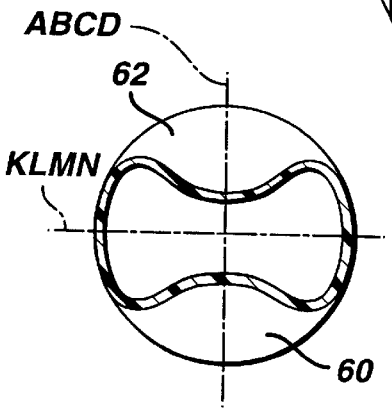
FIG. 12A

NURSING BOTTLE WITH GRIPPING RECESSES

BACKGROUND OF THE INVENTION

1. Field of the Invention

The present invention relates generally to a baby bottle from which an infant may drink a liquid such as milk, juice or water. More particularly, the present invention relates to a baby bottle which provides improved ease of gripping during use. Even more particularly, the present invention relates to a baby bottle comprising a depression on the front side thereof for receiving an infant's fingers during use and a depression on the rear side thereof for receiving an infant's thumbs during use.

2. Description of the Prior Art

Conventional nursing bottles are usually of a substantially cylindrical configuration in which the bottle and the attached nipple have a common longitudinal axis. These types of bottles are generally referred to as straight nursing bottles and have deficiencies in that the base of the bottle must be tipped increasingly upwardly as the contents of the bottle are consumed in order to keep the nursing fluid available to the opening in the nipple. Tipping the bottle upward results in tipping the infant's head back or inclining the infant in a more supine position in order to facilitate feeding. Such positioning of the infant during feeding is not recommended by pediatricians due to the possibility of fluid entering the Eustachian tube and possibly contributing to inner ear infections.

Angled bottles were developed to facilitate feeding without the need to incline the infant or for the infant to tilt his or her head back. See, e.g. U.S. Pat. Nos. 4,676,387 to Stephenson and 4,832,213 to Sharon. These bottle designs aid in keeping the nipple opening contiguous with the fluid inside the bottle while mitigating the need to tilt the bottle. These designs are deficient in instances where the infant holds the bottle for himself or herself since they lack a grippable area which is suitable for an infant's hands.

Grippability was incorporated in an angled bottle as shown in Dansfield, U.S. Pat. No. 4,867,325. This bottle is toroidal in shape with grippable sides. The design is intended to produce a highly stable bottle when placed on its side and also to provide a large surface area for rapidly warming the contents. This bottle is deficient in that the means of gripping is not ergonomically acceptable for a self-feeding infant (the wrists would be bent in an unnatural position) and cleaning of the bottle would be extremely difficult.

Straight bottles which are more easily gripped by self-feeding infants are shown in U.S. Pat. Nos. 4,570,808 to Campbell and 4,813,556 to Lawrence. The Campbell patent discloses a bottle which has a grippable area for the infant's hands; however, the bottle's straight design requires tipping of the bottle to fully deliver its contents. The Lawrence patent discloses a bottle which has a bellows-shaped top near the open end and a pair of opposing recesses which form portions of the body surface into a pair of handles to facilitate gripping during self-feeding. The purpose of the bellows is to remove air from the container since this section of the bottle is collapsible. This bottle is deficient in that the pair of recesses therein are not ergonomically positioned so as to allow the infant to place his or her thumbs in a natural position during feeding.

SUMMARY OF THE INVENTION

In accordance with the present invention, there is provided an infant's feeding bottle, which may be either of the "straight" type or the "angled" type, having a pair of indentations or depressions therein. The first of these indentations or depressions is located on the front of the bottle and is adapted to receive one or more of an infant's finger when the bottle is in use. The second indentation or depression is located on the back of the bottle generally opposite the location of the first indentation and is adapted to receive at least one of the infant's thumbs while the bottle is being used. The indentations are preferably located closer to the open end of the feeding bottle than to its closed end so as to make it easier for the infant to manipulate the bottle during use.

In addition to defining a first region in the bottle for receiving one or more of the infants fingers and a second region for receiving one or both of the infant's thumbs, the pair of opposed indentations or depressions reduce, in the vicinity of their location, the volume of the bottle available for containing fluids. The depressions accordingly aid in keeping small amounts of fluid available to the opening in the affixed nipple when the bottle is being used.

Preferably, the indentation which is adapted to receive one or more of the infant's fingers is of sufficient size so as to be able to receive several of the infant's fingers. More preferably, the finger receiving indentation is of a size sufficient to receive all eight of the infant's fingers. Similarly, the second, or thumb receiving, indentation is of a size sufficient to accommodate at least one of the infant's thumbs. Preferably, the second indentation is of a size sufficient to receive both of the infant's thumbs. It will be understood that each of the first and second indentations in the bottle of the invention may be sized for different ages or different age ranges. For example, the first and second indentations provided in a feeding bottle intended for use by an infant whose age is 6 months will be smaller than the respective indentations provided in a bottle intended for use by an infant whose age is one year.

In another aspect of the invention, the first and second indentations or depressions are displaced longitudinally with respect to each other. Preferably, the first indentation, i.e. the finger receiving indentation, is positioned further from the open end of the bottle than the second indentation, i.e. the thumb receiving indentation, so as to accommodate the anatomical configuration and positioning of the infant's hands during use of the bottle. This placement of the first and second indentations in the feeding bottle of the present invention allow the infant's arms and hands to assume a natural and comfortable position during use.

BRIEF DESCRIPTION OF THE DRAWINGS

FIG. 12 is a perspective view showing the intersection of plane ABCD with plane KLMN to form an angle of 9°;

FIG. 12A is a cross-section taken along line 12A—12A of FIG. 12;

DESCRIPTION OF THE PREFERRED EMBODIMENT

Figure 1:
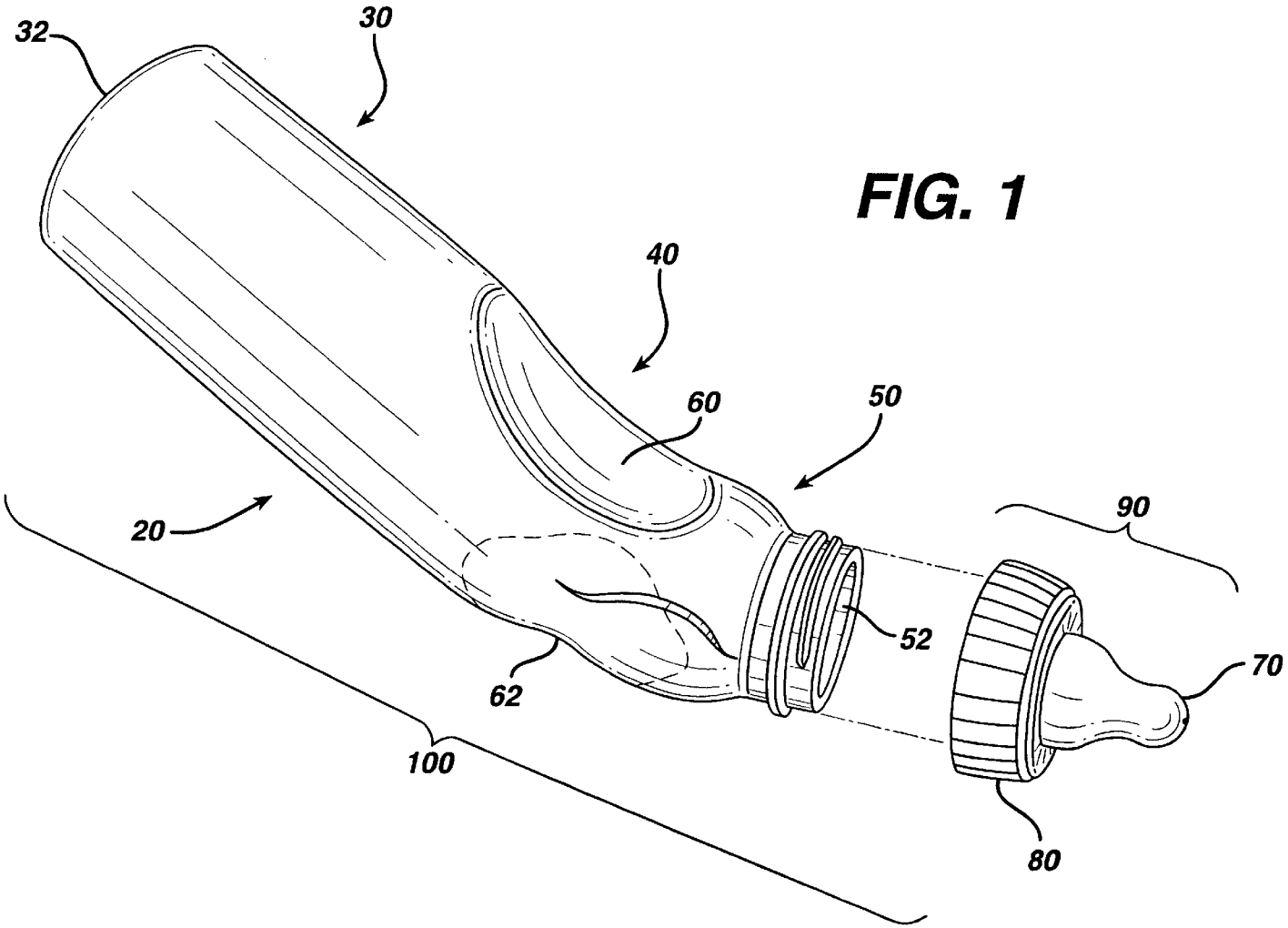
FIG. 1 is a perspective view of an embodiment of a nursing bottle according to the present invention.

Referring now to FIGS. 1–12 of the appended drawings, there is shown one preferred embodiment of a feeding bottle in accordance with the present invention. Feeding bottle 20, together with nipple 70 and retaining collar 80, constitute, when the nipple/collar assembly 90 is secured to the open end of the bottle, a feeding bottle system 100 which can be used to feed liquids to an infant. It will be understood that retaining collar 80 includes interiorly located threads, which threads, however, are not illustrated in the drawings.

As seen in the drawings, bottle 20 is hollow and comprises a lower, or body, portion 30; an intermediate, or neck, portion 40; and an upper, or head, portion 50.

Figure 4:
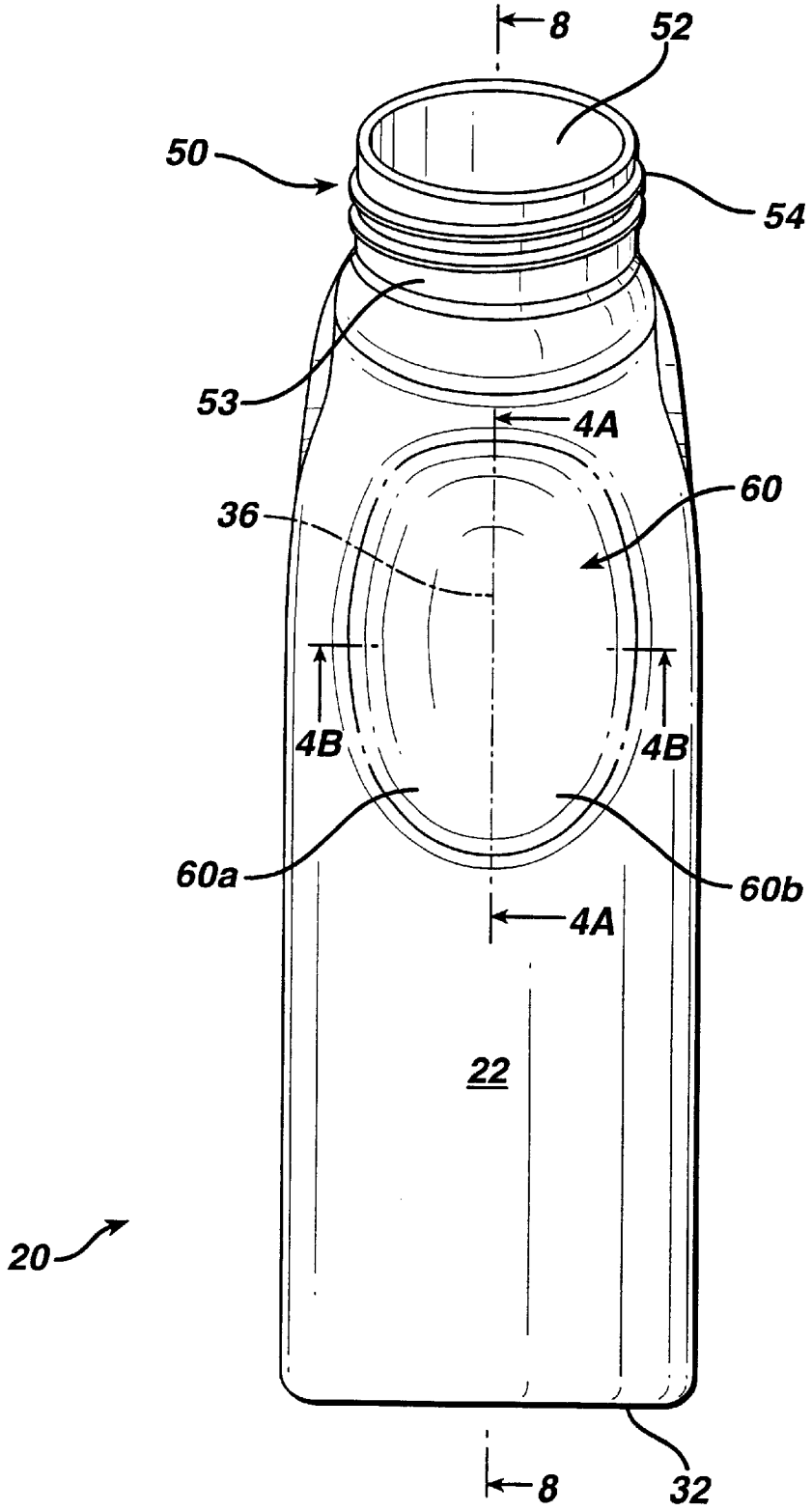
FIG. 4 is a front elevational view of the bottle of FIG. 1.
Figure 5:
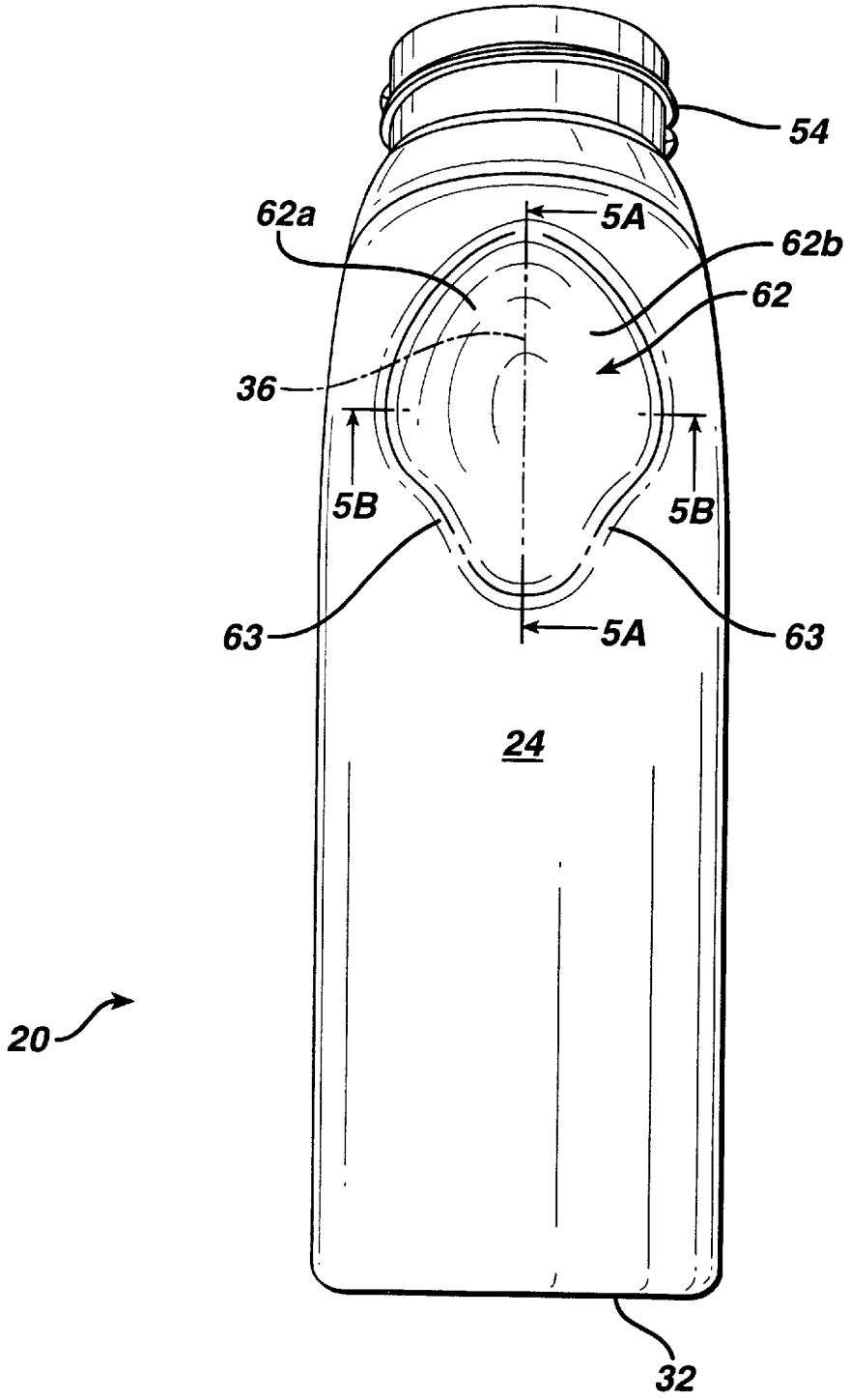
FIG. 5 is a rear elevational view of the bottle of FIG. 1.
Figure 6:
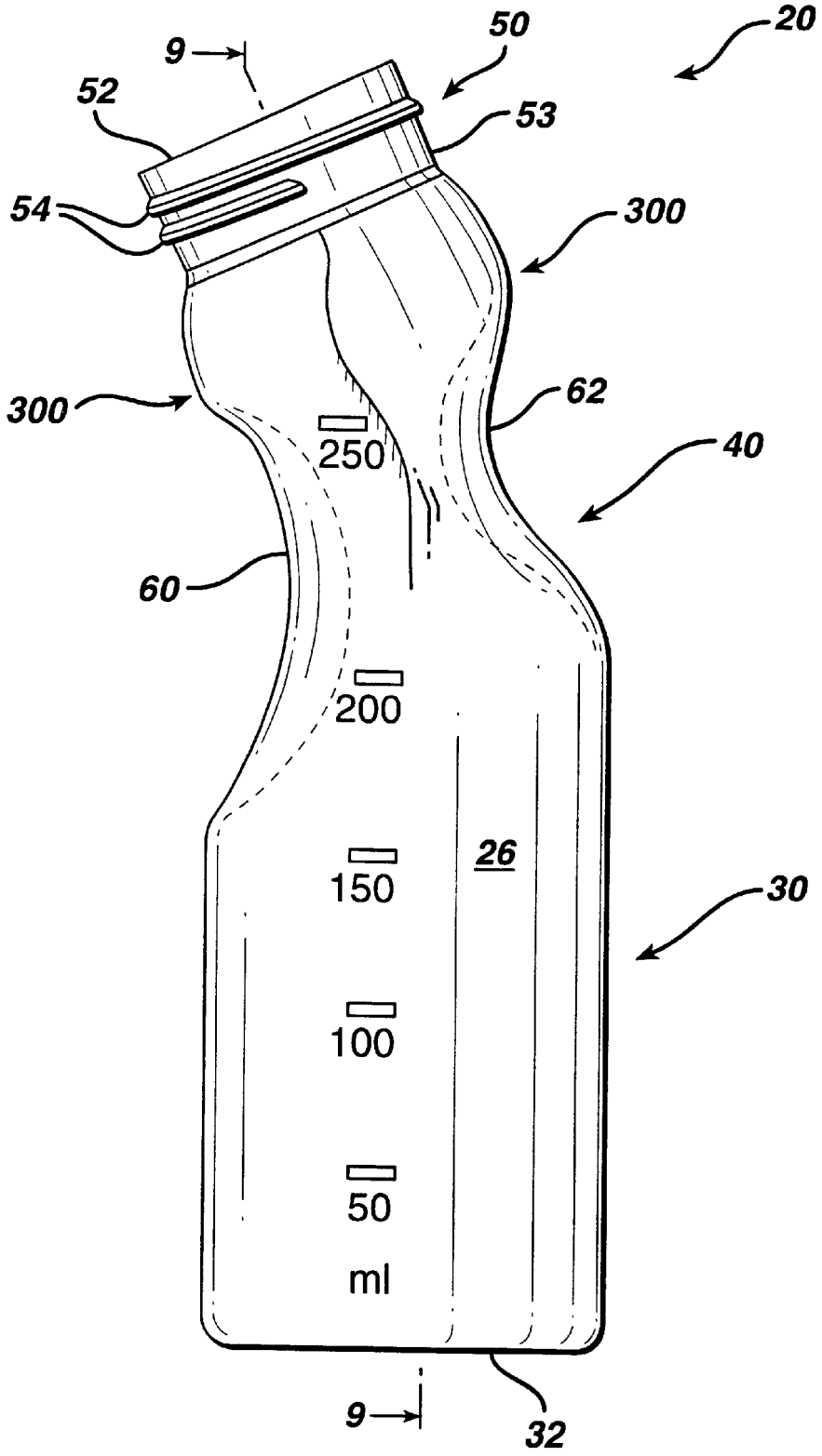
FIG. 6 is a left side elevational view of the bottle of FIG. 1.
Figure 7:
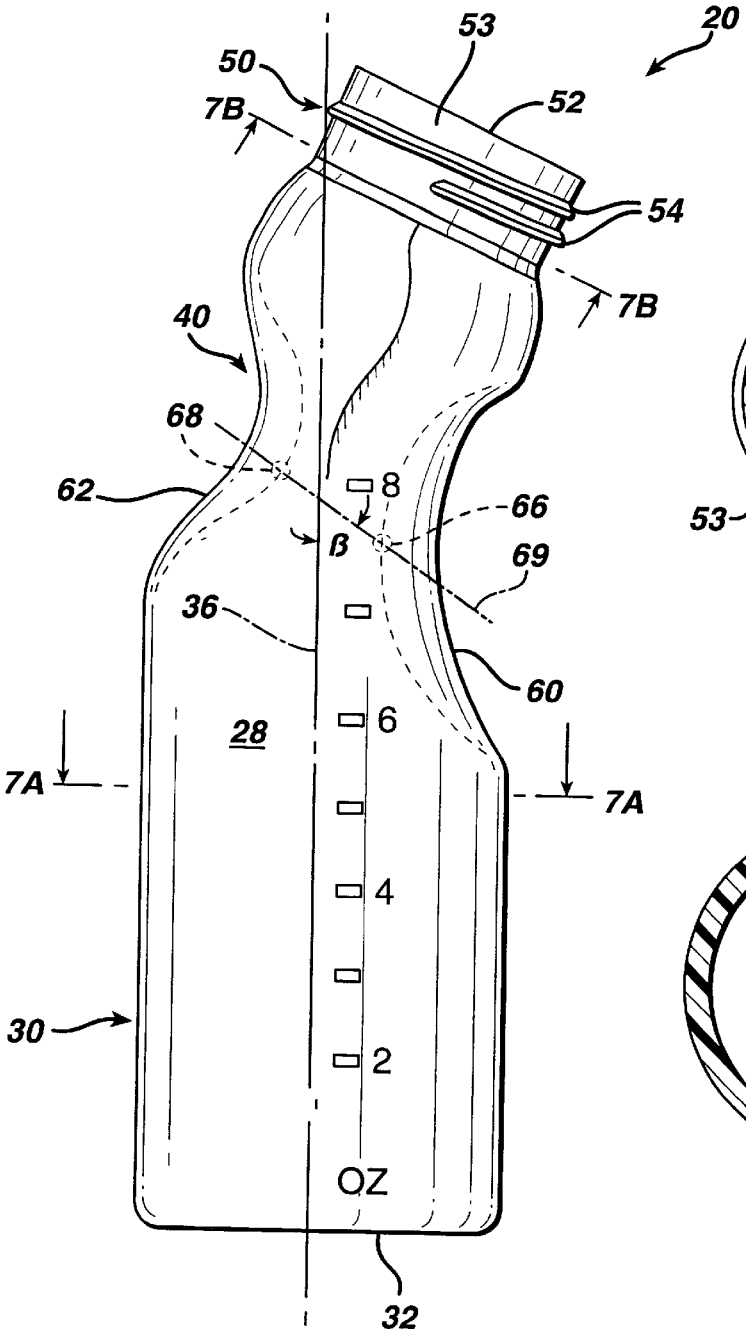
FIG. 7 is a right side elevational view of the bottle of FIG. 1.

Bottle 20 comprises a front surface 22 which is most clearly seen in FIG. 4 of the drawings, and a rear or back surface 24, which is most clearly seen in FIG. 5. The bottle further includes a first, or left, side 26 which is seen in FIG. 6 and a second, or right, side 28 which is seen in FIG. 7.

Figure 8:
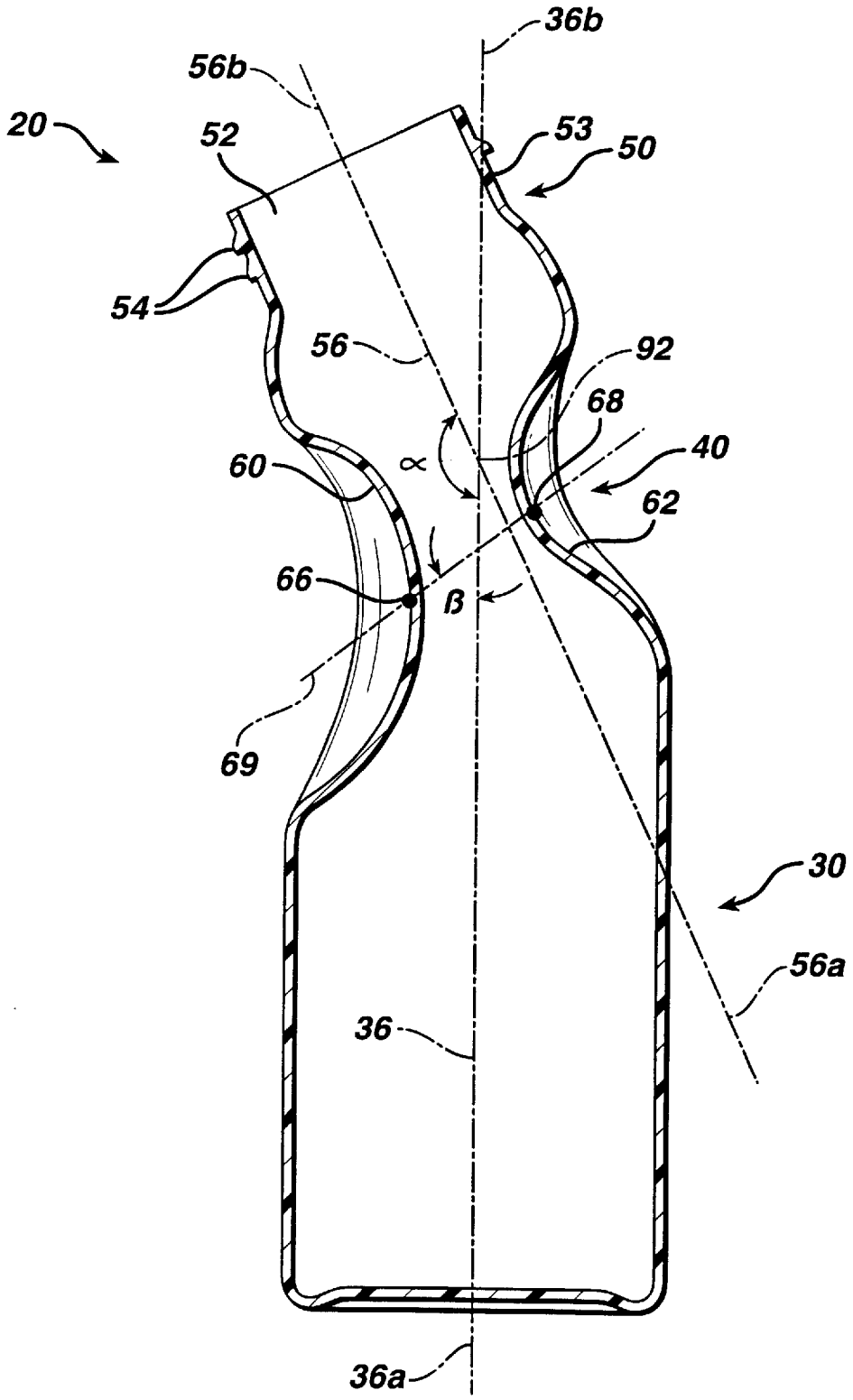
FIG. 8 is a cross-sectional view taken along line 8—8 of FIG. 4.

Body portion 30 has a closed end 32 which constitutes the lowermost, closed end of bottle 20. As can be seen in FIG. 8, closed end 32 is slightly inwardly recessed.

Head portion 50 terminates at its upper end in a circular portion 53 which carries male threads 54 which are adapted to receive the aforementioned interiorly located threads of collar 80 in mating relationship. Head portion 50 further includes an open end 52 which constitutes the uppermost, open end of bottle 20. Head portion 50 terminates at its lower end in a region 300 that is above and abuts the depressions 60, 62.

Referring particularly to FIG. 8, it will be understood that body portion 30 has a longitudinal axis 36 which can be extended beyond the outer surface of bottle 20 as indicated by dot-and-dash line 36*a* at the bottom of the bottle and by dot-and-dash line 36*b* at the top of the bottle. Similarly, head portion 50 has a longitudinal axis 56 which can be extended beyond the outer surface of the bottle as indicated by dot-and-dash line 56*a* (seen in the lower right hand portion of FIG. 8) and by dot-and-dash line 56*b* at open end 52. The head region 300 in the head portion 50, which is above and abuts the depressions 60, 62, has a longitudinal axis extending therethrough. The longitudinal axis of the head region 300 is coaxial with the longitudinal axis of the head portion 50, but is not coaxial with the longitudinal axis through the body portion 30. Still referring to FIG. 8, it will be seen that axis 36 and axis 56 intersect at intersection point 92 located interiorly of neck portion 40 to form an angle $\alpha$. In angled bottle 20, angle $\alpha$ may suitably range from about 135° to about 175°. Preferably, angle $\alpha$ ranges from about 145° to about 165°. Even more preferably, angle $\alpha$ ranges from about 150° to about 155°.

Figure 2:
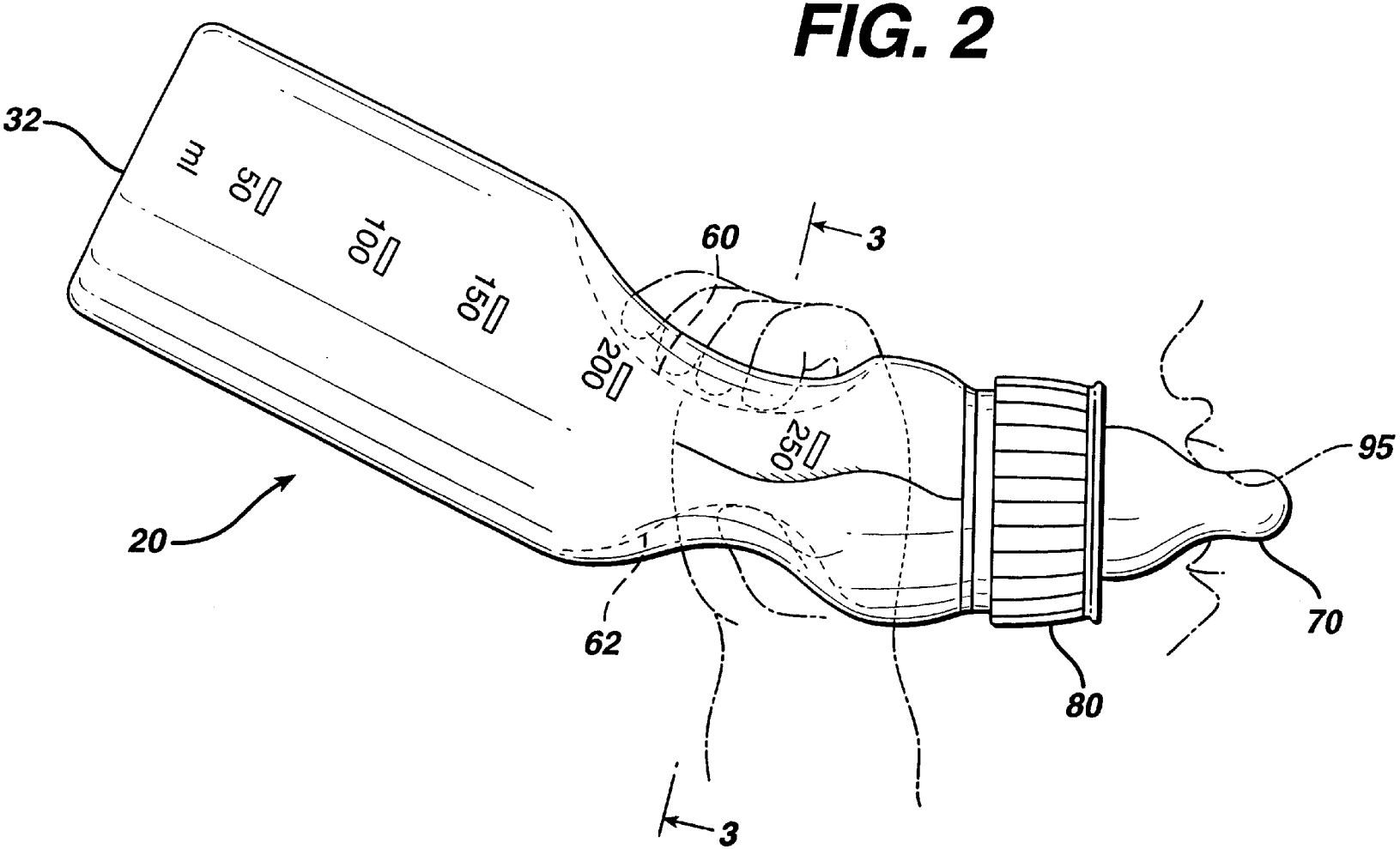
FIG. 2 is a perspective view of the nursing bottle of FIG. 1 being used by an infant, the infant's right hand and mouth being shown in phantom.
Figure 3:
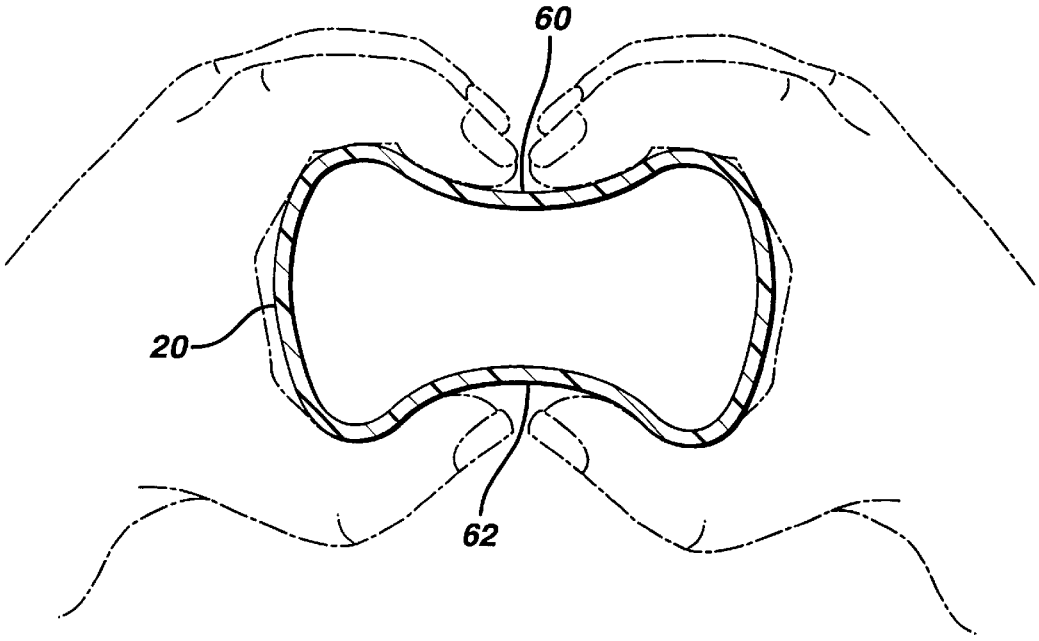
FIG. 3 is a cross-sectional view of the bottle of FIG. 1 taken along line 3—3 of FIG. 2, said bottle being illustrated in the fashion in which it might be held in the hands of an infant during use.

Bottle 20 further comprises two indentations or depressions. As may be seen in FIG. 4, the first such indentation or depression, identified by numeral 60, is located in the front surface 22 of bottle 20. As may be seen in FIG. 5, the second such depression or indentation, identified by numeral 62, is located in the rear, or back, surface 24 of bottle 20. Preferably, first depression 60 is larger than second depression 62. As can be seen in FIG. 2 and FIG. 3, depression 60 on the front of bottle 20 is adapted to receive the fingers of an infant while the bottle is being used. Although only the fingers of the infant's right hand are shown (in phantom) in FIG. 2, it will be understood that the infant may also place one or more fingers of his or her left hand in indentation 60.

Similarly, depression 62 on the rear of bottle 20 is adapted to receive an infant's thumbs when the bottle is being used. FIG. 2 shows the infant's right thumb (in phantom) in place in depression 62. It will be understood that the infant may also place the thumb of his or her left hand into indentation 62. FIG. 3 illustrates both of the infant's thumbs positioned in depression 62.

The shape of the bottle, as viewed along its cross-section through the two depressions as shown in FIG. 3, is comprised of a central region having a width and a pair of transverse end regions. The width of each of the transverse end regions is greater than the width of the central region, which is comprised of two continuous arcuate lateral sides. Each lateral side begins at a first transverse end region and terminates at a second transverse end region.

As mentioned, first depression 60, which is adapted to receive the infant's fingers, is preferably larger in size than second depression 62, which is adapted to receive the infant's thumbs. Since the infant's fingers occupy more space than the infant's thumbs, the infant will soon learn that it is easier to place the fingers in larger-sized depression 60 than in the smaller sized depression 62. Though smaller in size than depression 60, second depression 62 readily accepts the infant's thumbs. Thus, when first depression 60 is made larger than second depression 62, the infant is encouraged and with use of the bottle soon learns to place the fingers in first depression 60 and the thumbs in second depression 62. When this happens, the infant, during use of the bottle, holds the bottle in the desired position, shown in FIG. 2, in which the closed end 32 of the bottle is tilted upwardly from the infant's mouth 95.

Figure 7B:
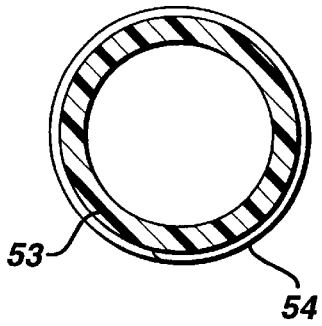
FIG. 7B is a cross-sectional view taken along line 7B—7B of FIG. 7.
Figure 7A:
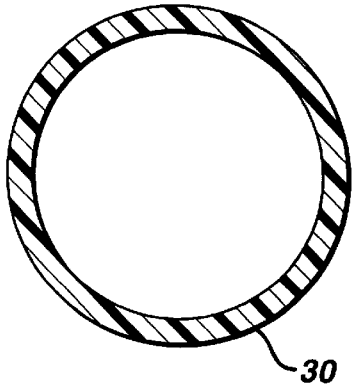
FIG. 7A is a cross-sectional view taken along line 7A—7A of FIG. 7.

In the preferred embodiment under discussion, and as shown in FIG. 7A, the lower reach of body portion 30 is substantially circular in cross-section. As mentioned above, and as can be seen in FIG. 7B, portion 53 at the open end of bottle 20 is also substantially circular in cross-section. Portion 53 is thus adapted to receive, in well known fashion, nipple/collar assembly 90 for completing the feeding bottle system 100.

As seen in FIGS. 6 and 7, first depression 60 is located between open end 52 and closed end 32 of bottle 20. Second depression 62 is located closer to the open end of the bottle than first depression 60. In other words, in the preferred embodiment, depressions 60 and 62 are longitudinally offset with respect to one another. As seen in FIG. 7, depression 60 has a geometric centerpoint 66 and depression 62 has a geometric centerpoint 68. As seen in FIGS. 7 and 8, a line 69 which passes through centerpoints 66 and 68 forms an angle β with the longitudinal axis 36 of body portion 30. It will be understood that depressions 60 and 62 will be longitudinally offset with respect to each other so long as angle β is less than 90°. Angle β may suitably range from about 20° to about 60°. Preferably angle β ranges from about 30° to about 50°, more preferably from about 40° to about 45°.

Figure 4A:
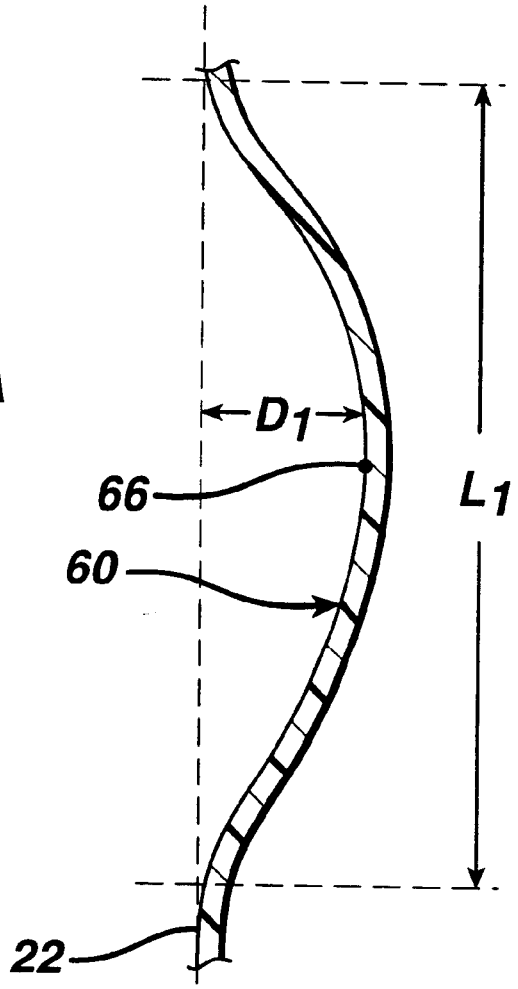
FIG. 4A is a cross-sectional view taken along line 4A—4A of FIG. 4.
Figure 4B:
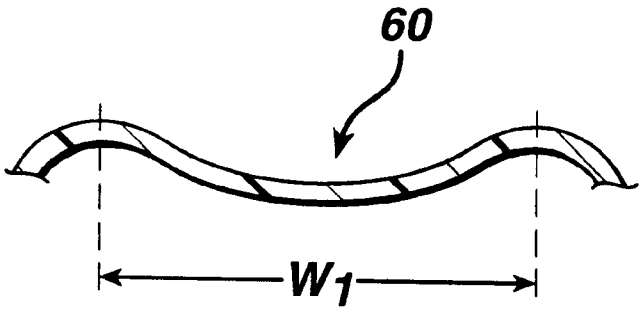
FIG. 4B is a cross-sectional view taken along line 4B—4B of FIG. 4.

The perimeter of depression 60 at front surface 22 of bottle 20, when viewed in plan, and as shown in FIG. 4, is generally elliptical in shape. The walls of depression 60 taper in arcuate fashion and substantially uniformly to centerpoint 66. A longitudinal section of depression 60 is shown in FIG. 4A; a cross-section of depression 60 is shown in FIG. 4B. In one embodiment, depression 60 has a length, $L_1$, on the order of 2⅜ inches, and a width, $W_1$, on the order of 1.5 inches. It will be recognized that the foregoing dimensions may be varied depending on the specific size desired for depression 60.

Figure 5A:
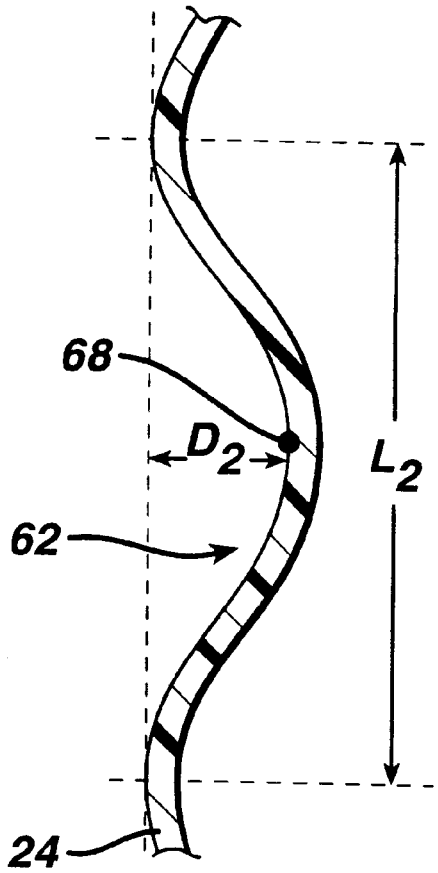
FIG. 5A is a cross-sectional view taken along line 5A—5A of FIG. 5.
Figure 5B:
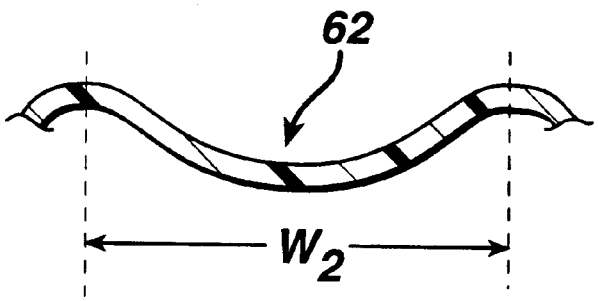
FIG. 5B is a cross-sectional view taken along line 5B—5B of FIG. 5.

The perimeter of depression 62 at front surface 22 of bottle 20, when viewed in plan, and as shown in FIG. 5, is generally elliptical in shape, being longer than it is wide. Depression 62 has a pair of small, inwardly recessed regions 63,63 near its bottom, one on each side of longitudinal axis 36. The walls of depression 62 taper in arcuate fashion and substantially uniformly to its centerpoint 68. A longitudinal section of depression 62 is shown in FIG. 5A; a cross-section of depression 62 is shown in FIG. 5B. In one embodiment, depression 62 has a length, $L_2$, on the order of 2 inches, and a width, $W_2$, on the order of 1.5 inches. It will be recognized that the foregoing dimensions may be varied depending on the specific size desired for depression 62.

The depth, $D_1$, of depression 60 and the depth, $D_2$, of depression 62 may vary depending on the desired size of the depression. Typically $D_1$ may range from about 0.25 inch to about 0.75 inch and $D_2$ may range from about 0.125 inch to about 0.75 inch.

Figure 9:
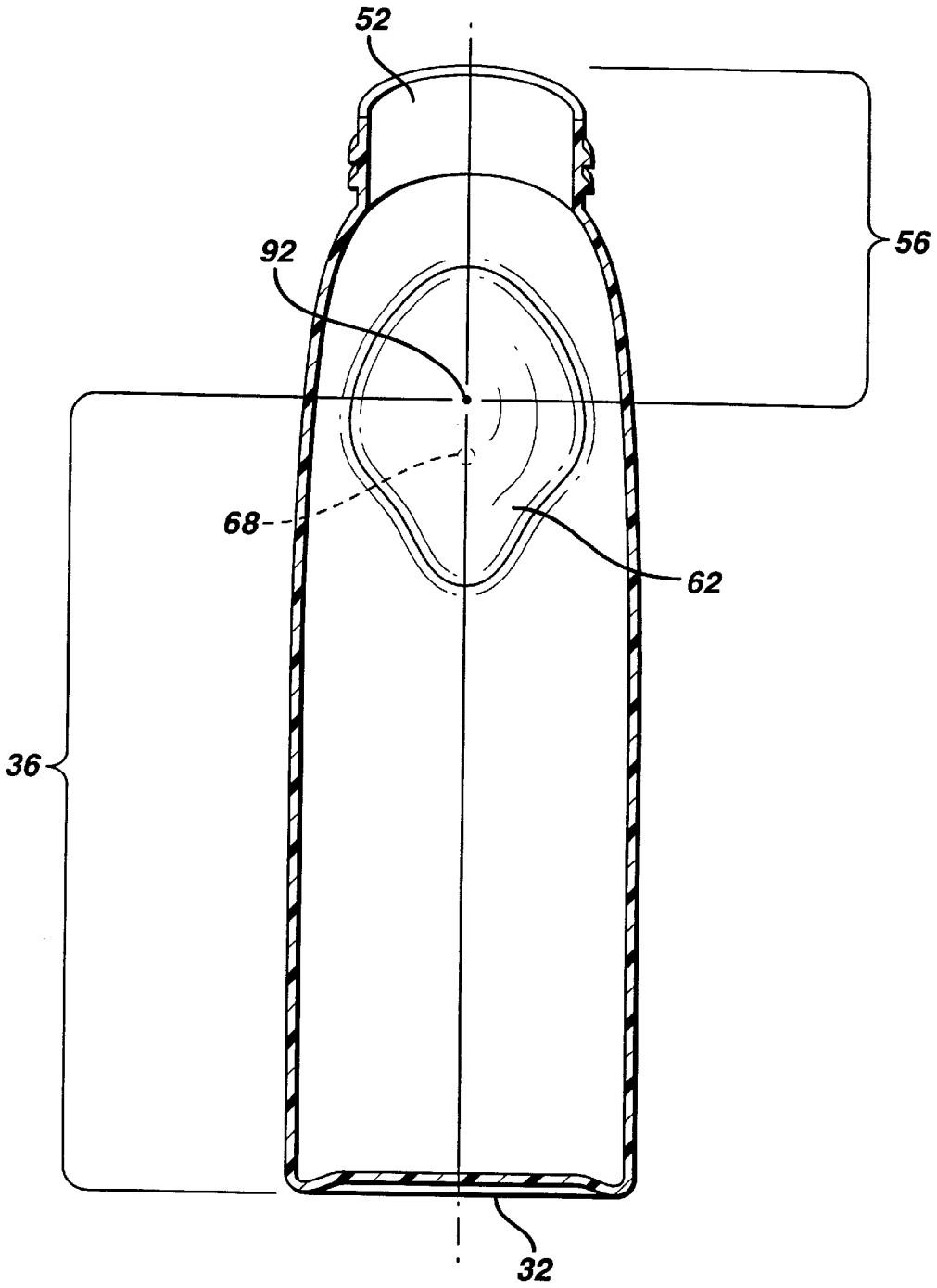
FIG. 9 is a longitudinal section taken along line 9—9 of FIG. 6.

FIG. 9 is a cross-sectional view of bottle 20 taken along line 9—9 of FIG. 6 and shows axis 36, axis 56, the point 92 at which axis 36 and axis 56 intersect each other, depression 62, centerpoint 66 of depression 62, closed end 32 and open end 52.

Figure 10:
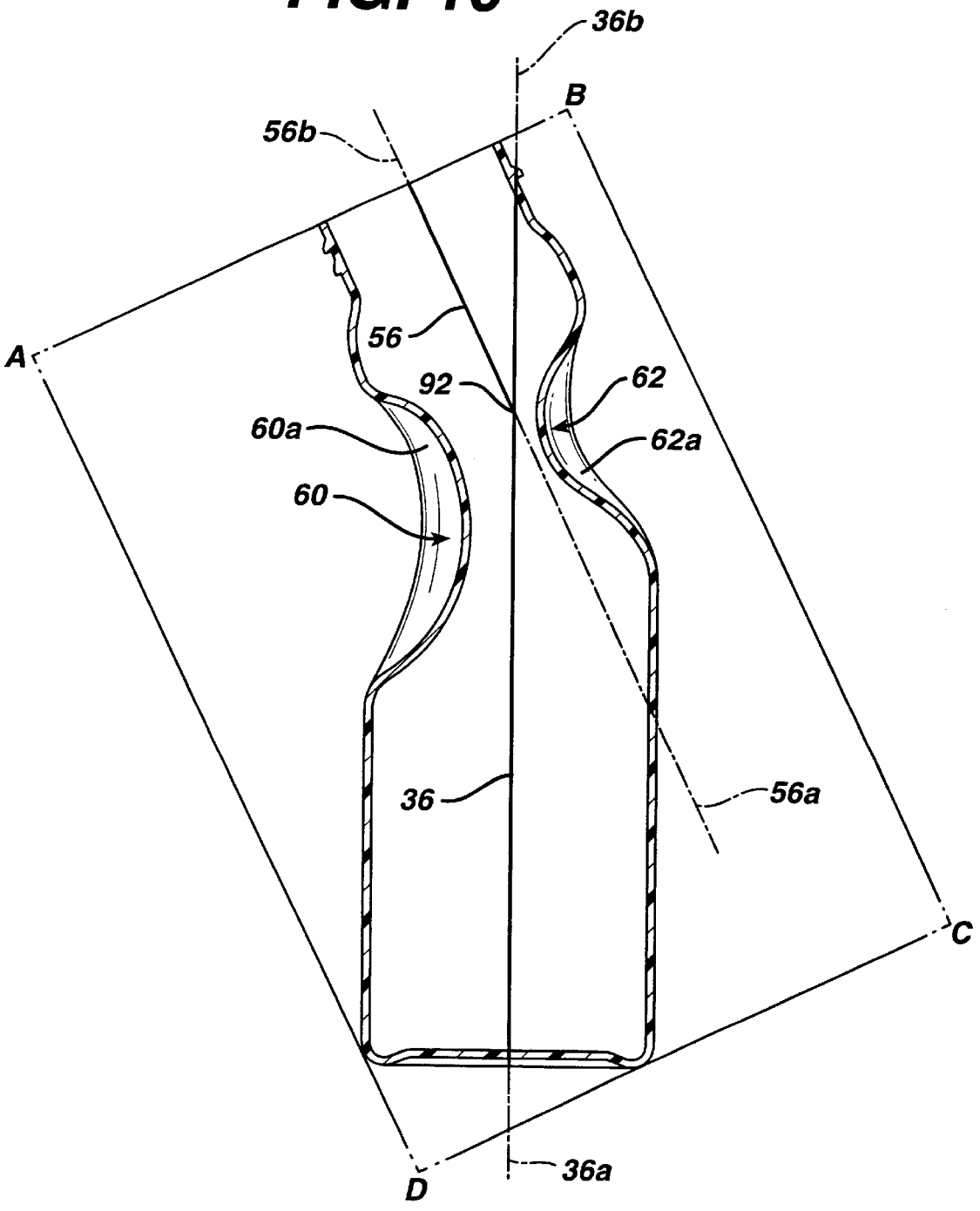
FIG. 10 is a cross-sectional view similar to FIG. 8 and showing a unique plane ABCD passing through the intersecting longitudinal axes of the upper and lower portions of the bottle of FIG. 1.

FIG. 10 shows unique plane ABCD passing through both longitudinal axis 36 of body portion 30 and longitudinal axis 56 of upper portion 50. Plane ABCD divides first depression 60 into two parts 60*a*, 60*b* and also divides second depression 62 into two parts 62*a*, 62*b*. Part 60*a* and part 62*a* are seen in FIG. 10. See also FIGS. 4 and 5. In the preferred embodiment of angled bottle 20, plane ABCD divides first depression 60 into identical halves and also divides second depression 62 into identical halves, said identical halves being mirror images.

Figure 11:
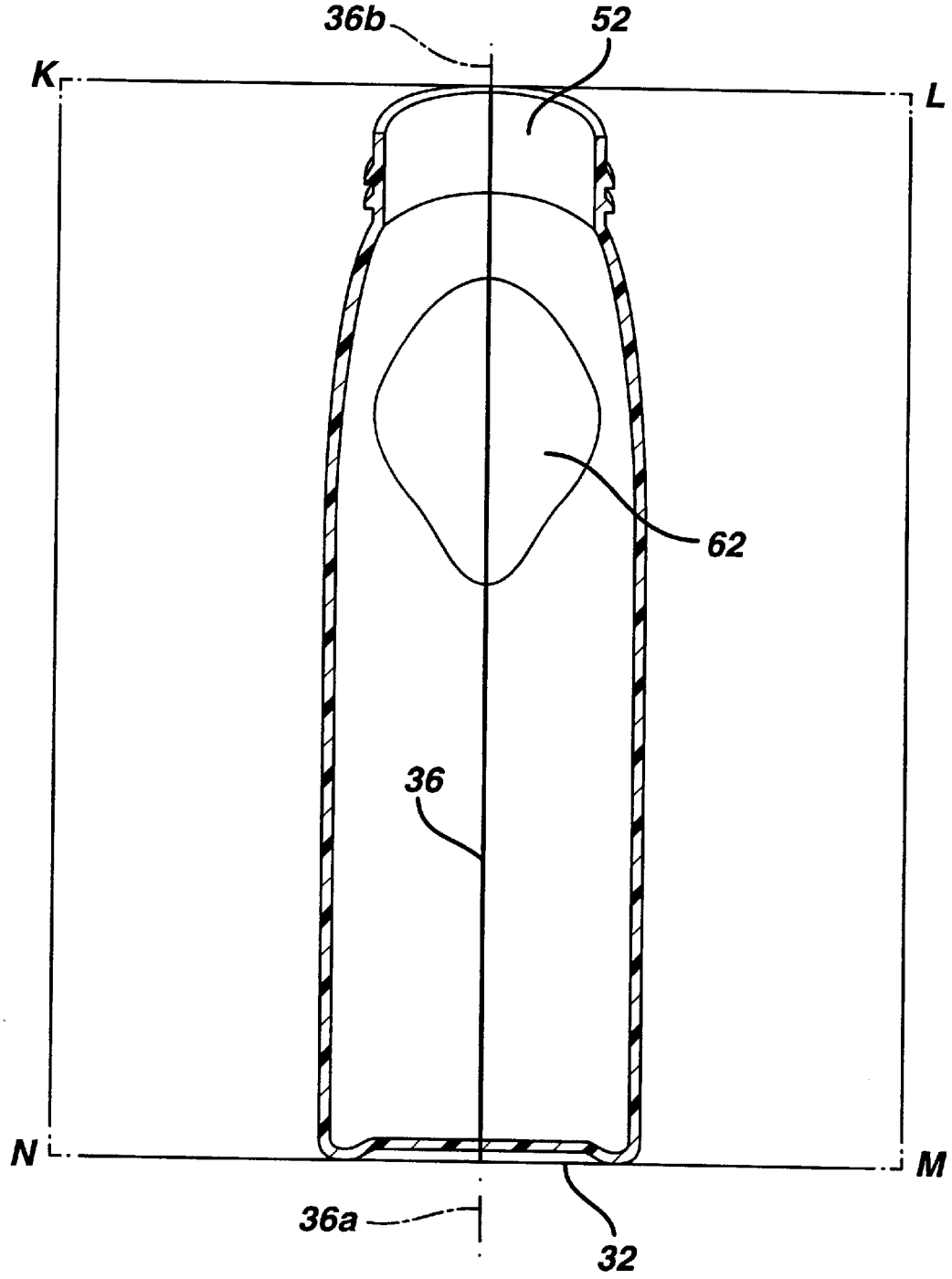
FIG. 11 is a cross-sectional view similar to FIG. 9 and showing a unique plane KLMN passing through the longitudinal axis of the body portion of the bottle and forming an angle of 90° with plane ABCD.

FIG. 11 shows a second unique plane KLMN which passes through longitudinal axis 36 of body portion 30 of bottle 20 and forms an angle of 90° with above-mentioned plane ABCD. It will be understood that depression 62 is located on one side of plane KLMN and depression 60 (not shown in FIG. 11) is located on the other side of plane KLMN.

FIG. 12 is a perspective view of bottle 20 showing the intersection of plane ABCD and plane KLMN to form an angle of 90°. As seen in FIG. 12A, first depression 60 lies on one side of plane KLMN, while second depression 62 lies in the opposite side thereof. Plane ABCD divides depression 60 and depression 62 into identical halves.

In an angled bottle according to the invention, the bottle includes a concave region on its front surface and a convex region on its back surface. The first indentation or depression—the one designed for receiving the infant's fingers—is located in the general vicinity of the concave region. The second indentation or depression—the one adapted to receive the infant's thumbs—is located in the general vicinity of the convex region. Preferably, the first indentation is larger than the second indentation.

A sequential monadic home use test was conducted to determine the ease with which an infant or young child is able to grasp angled bottle 20 of the invention compared to the ease of gripping a control bottle. The control bottle which was used was similar to that disclosed in U.S. Pat. No. 4,676,387 to Stephenson and was substantially identical to inventive bottle 20 illustrated in FIGS. 1–12 of the drawings except that it did not have depressions 60 and 62. Parents of infants and young children were selected to form a test panel which was divided into two groups identified as Group A and Group B. Each of the two groups had an approximately equal number of panelists. The children of the parents constituting the test panel ranged in age from 4 months to 23 months in age. The Group A parents were given the inventive bottle of FIGS. 1–12 and a supply of nipples and retaining collars. The Group A parents were asked to use the mentioned inventive bottle for one week. The Group B parents were given the mentioned control bottle, along with a supply of nipples and retaining collars, and asked to use the same for one week. At the end of the first week, the panelists were asked to rate the parameter "Ease for Child to Grip/Hold" according to the following standards:

| Standard | Rating |
|---|---|
| Extremely easy to hold | 5 |
| Very easy to hold | 4 |
| Somewhat easy to hold | 3 |
| Slightly easy to hold | 2 |
| Not at all easy to hold | 1 |

During the second week, the Group A parents used the control bottle, while the Group B parents used the inventive bottle. At the end of the second week, the parents completed the same questionnaire and rated the particular bottle which they used during the second week.

The results of this home use test comparing the two bottles are set forth in TABLE 1. As seen in the Column entitled "OVERALL SAMPLE" in TABLE 1, seventy-two percent (72%) of the panelists rated the inventive bottle as being "extremely easy" or "very easy" for the child to grip/hold. In contrast, only fifty percent (50%) of the panelists rated the control bottle as being "extremely easy" or "very easy" for the child to grip/hold. The 72% rating achieved by the inventive bottle versus the 50% rating achieved by the control bottle is significantly different at $P \leqq 0.01$. These test results demonstrate that the bottle of the invention with its depressions 60 and 62 is significantly easier for the child to grip/hold than the control bottle which had no such depressions.

TABLE 1

| | OVERALL SAMPLE | | | AGES 4–10 MONTHS | | | AGES 10+ TO 23 MONTHS | | |
|---|---|---|---|---|---|---|---|---|---|
| | Current n = 86 | | Prototype n = 88 | Current n = 44 | | Prototype n = 45 | Current n = 42 | | Prototype n = 43 |
| Extremely easy (5) | 19% | | 34% | 20% | | 36% | 17% | | 33% |
| Very easy (4) | 31% | | 38% | 27% | | 33% | 36% | | 42% |
| Somewhat easy (3) | 26% | | 13% | 23% | | 16% | 29% | | 9% |
| Slightly easy (2) | 10% | | 8% | 14% | | 7% | 7% | | 9% |
| Not at all easy (1) | 14% | | 8% | 16% | | 9% | 12% | | 7% |
| Mean/Significance | 3.30 | *** | 3.82 | 3.23 | ** | 3.80 | 3.38 | * | 3.84 |
| % Top 2 Box Significance | 50% | *** | 72% | 47% | ** | 69% | 53% | ** | 75% |

SIGNIFICANCE LEVELS:
* = Significant at $p \leqq .10$
** = Significantly different at $p \leqq .05$
* = Significantly different at $p \leqq .01$ When the present invention is embodied in an angled bottle such as shown in FIGS. 1–12 of the accompanying drawings, the nipple tends to be kept filled with fluid while minimizing the need to tilt the bottle. TABLE 2 sets forth the Maximum Volume, Deliverable Volume, Undeliverable Volume and Maximum Volume Delivered for several commercially available baby bottles as well as the inventive bottle shown in FIGS. 1–12. The bottles were classified as shown in the left hand column of TABLE 2. The data in TABLE 2 demonstrates, as expected, the advantage of angled bottles over straight bottles in efficiently delivering liquid to the nipple. In general, the straight bottles deliver only about half their capacity while the angled bottles generally deliver more than about 75% of their capacity. The inventive bottle of FIGS. 1–12** delivers 85% of its capacity, a value which is higher than that of 3 of the angled bottles and less than 2 of those bottles.

Referring now to FIGS. 13–16, bottle 120 is shown in the form of a straight cylinder, i.e., it is not angled in the manner of bottle 20 of FIG. 1. Bottle 120 has a front surface 122 and rear, or back, surface 124. Bottle 120 is closed at its bottom end 132 and open at its top end 152. Proximate to the top end 152 are male threads 154 which are adapted to receive the aforementioned interiorly located threads of collar 80 in mating relationship.

Figure 13:
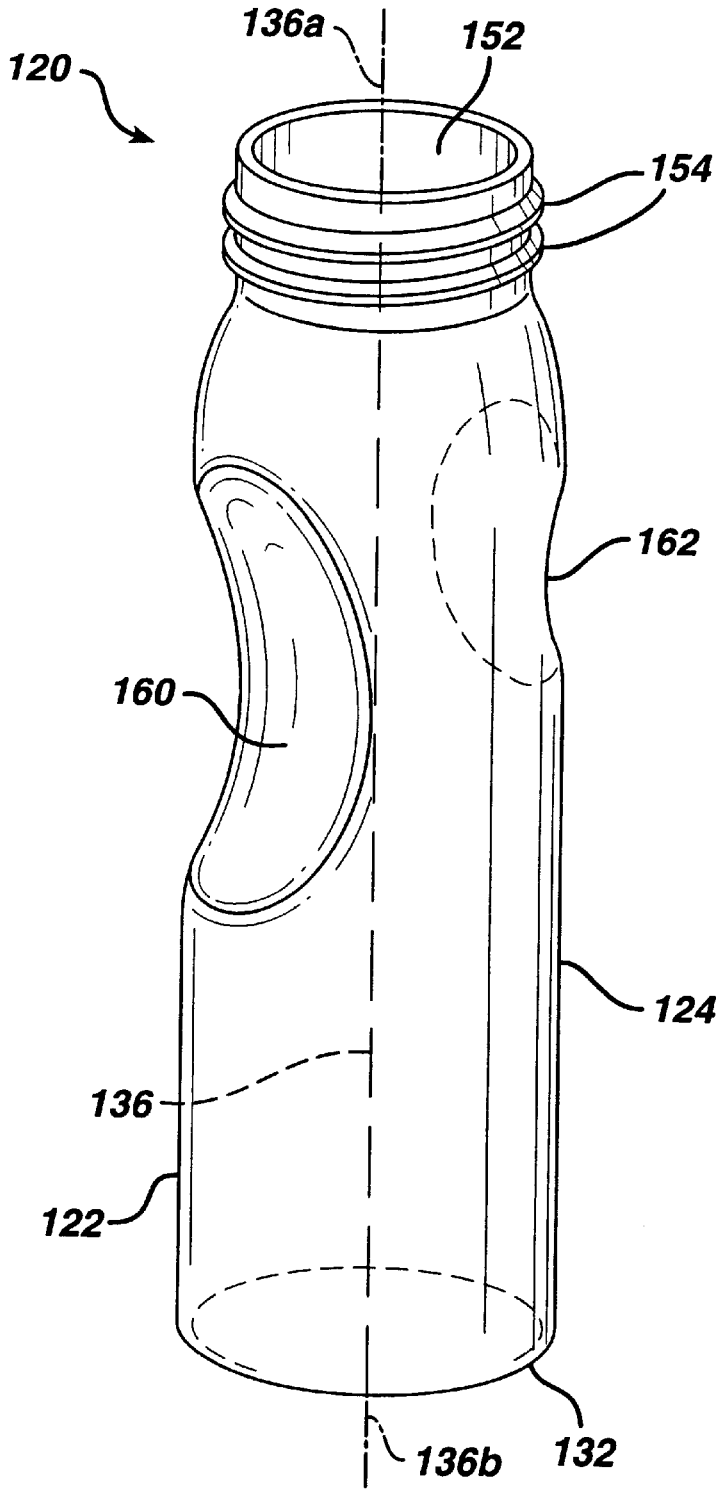
FIG. 13 is a perspective view of a second preferred embodiment of the present invention wherein the bottle is in the form of a straight cylinder and has no angled portions.
Figure 14:
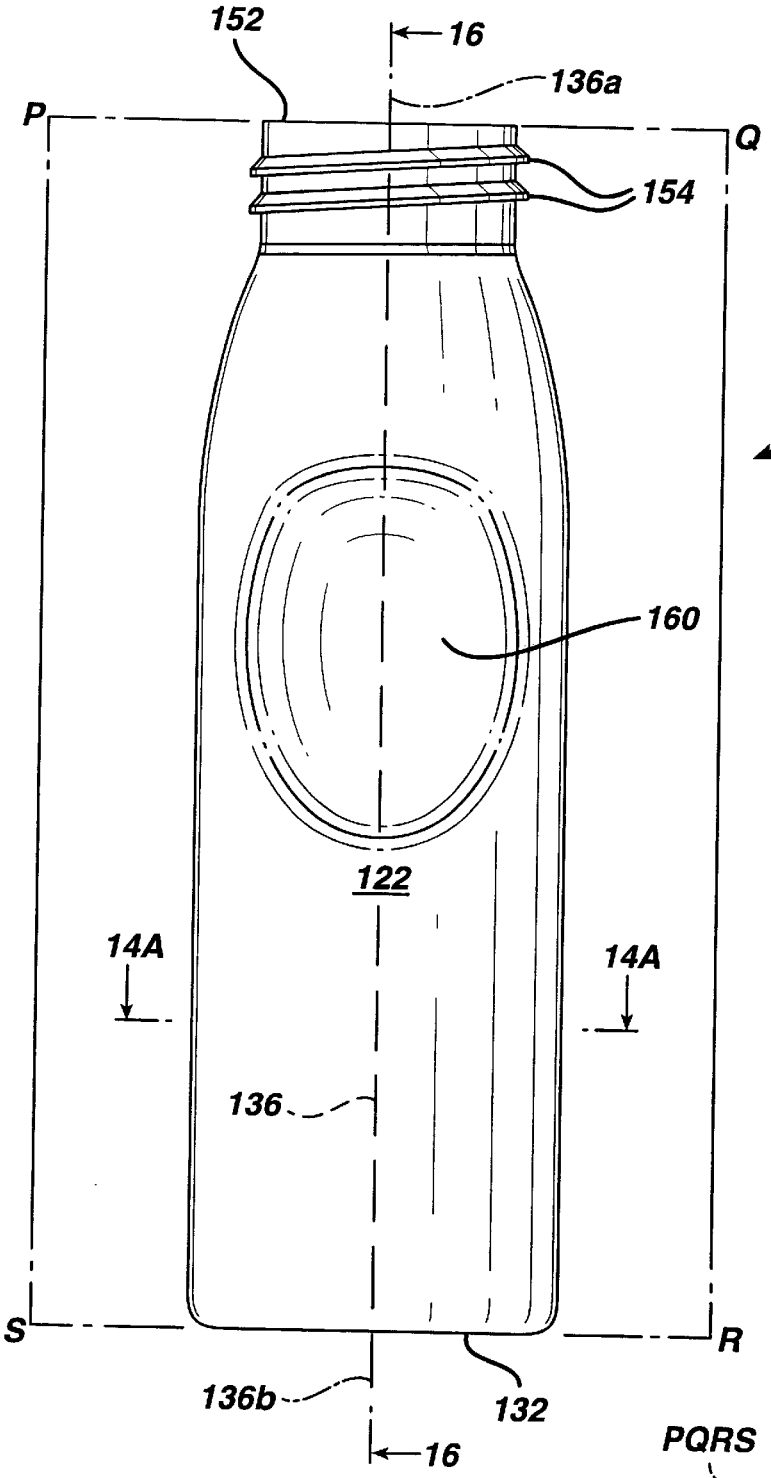
FIG. 14 is a front elevational view of the bottle of FIG. 13.
Figure 14A:
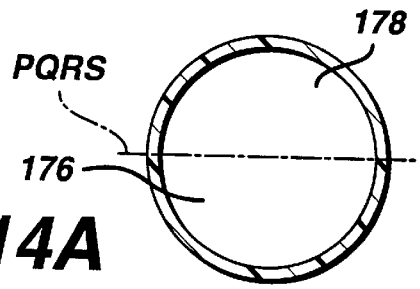
FIG. 14A is a cross-section taken along line 14A—14A of FIG. 14.
Figure 15:
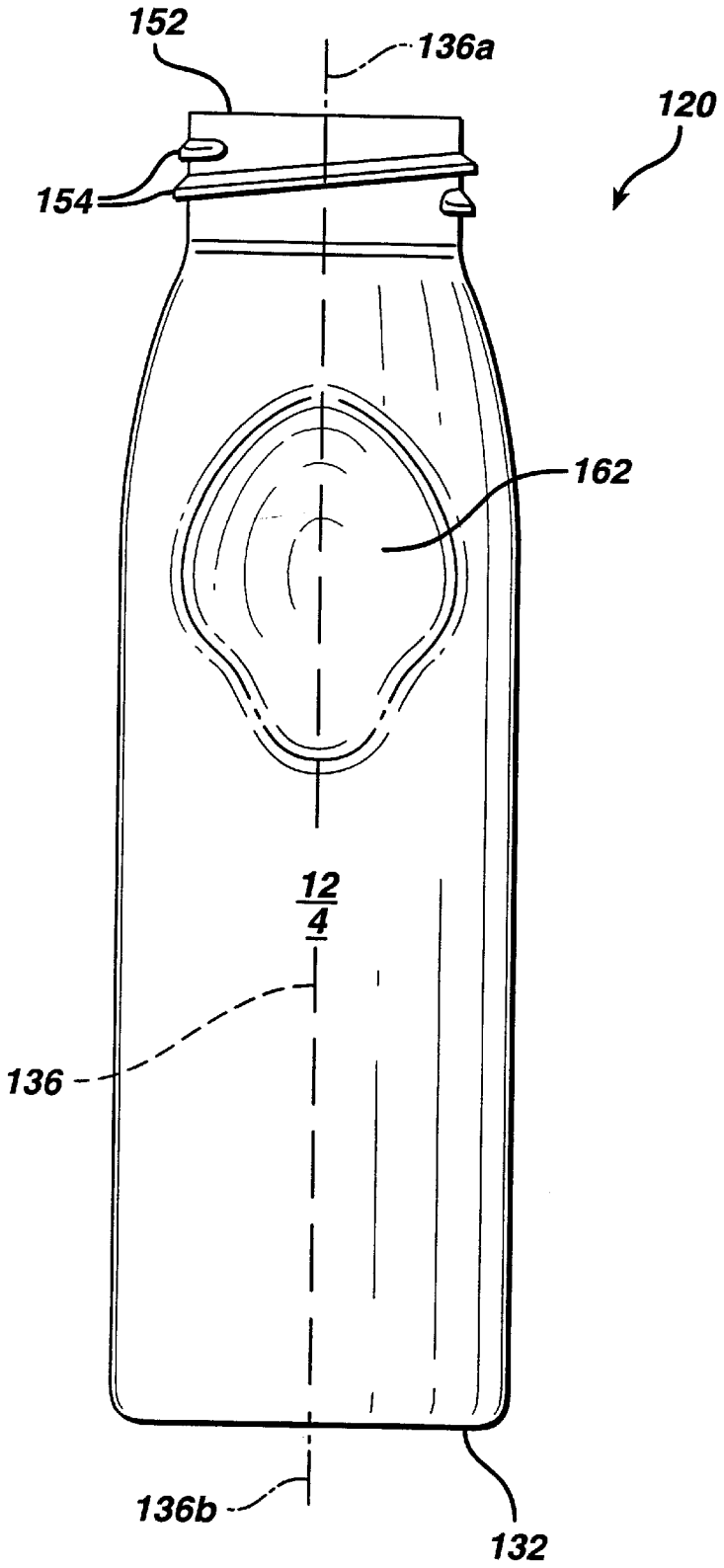
FIG. 15 is a rear elevational view of the bottle of FIG. 13.
Figure 16:
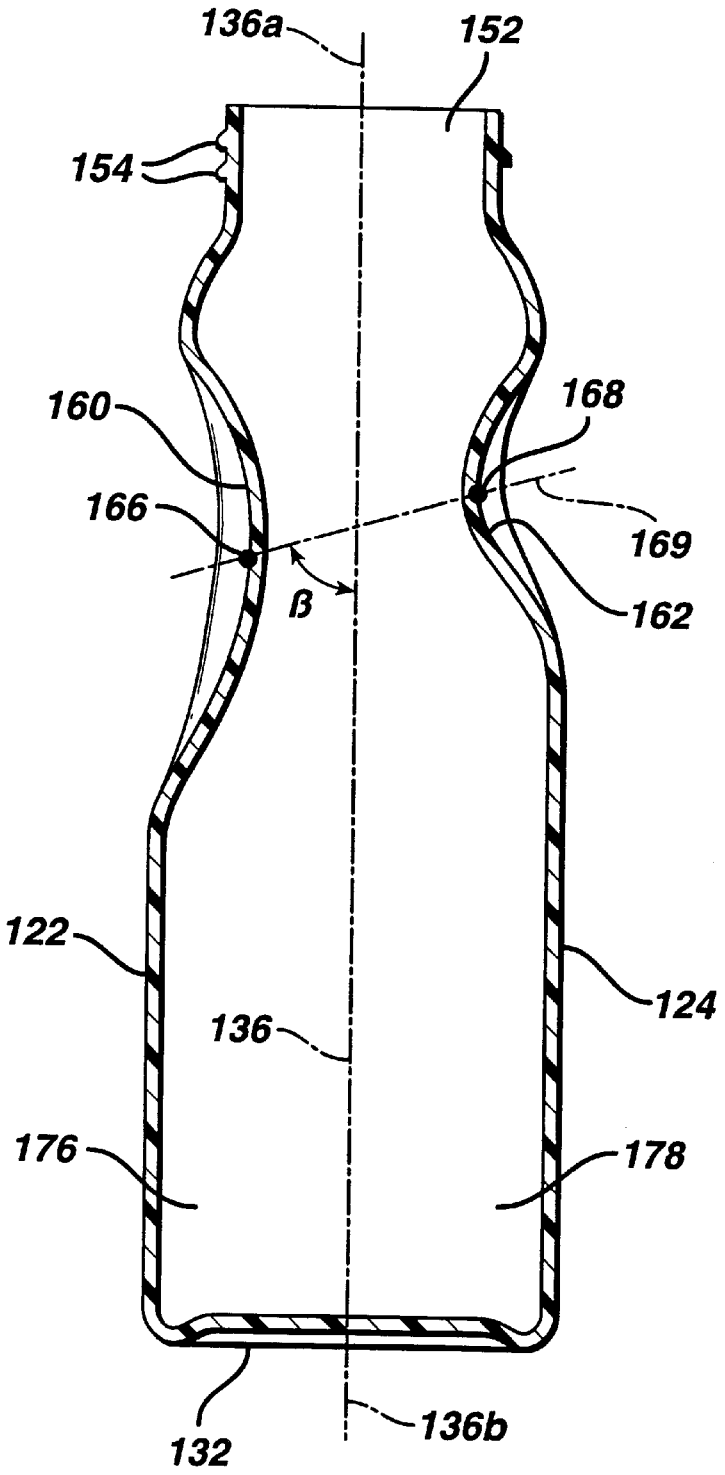
FIG. 16 is a cross-section taken along line 16—16 of FIG. 14.

Referring particularly to FIG. 13, it will be understood that the bottle 120 has a longitudinal axis 136 which can be extended beyond the outer surface of bottle 120 as indicated by dot-and-dash line 136*a* at the bottom of the bottle and by dot-and-dash line 136*b* at the top of the bottle. Front surface 122 includes a first depression 160 while back surface 124 includes a second depression 162, said depressions being analogous to depressions 60 and 62, respectively, of bottle 20. First depression 160 and second depression 162 are longitudinally offset one with respect to the other, second depression 162 being closer to open end 152 of the bottle. As seen in FIG. 14A, plane PQRS passing through the longitudinal axis 136 of bottle divides the bottle into a front half 176 and a back half 178. Depression 160 has a geometrical centerpoint 166 and depression 162 has a geometrical centerpoint 168. As seen in FIG. 16, a line 169 joining centerpoints 166 and 168 intersects longitudinal axis 136 to form an angle β which must be less than 90°. Preferably, in bottle 120, angle β ranges from about 55° to about 85°. More preferably, angle β ranges from about 65° to about 75°. Most preferably, angle β is about 70°. It will be understood that bottle 120 has the same "easy grip/hold" features mentioned earlier herein for bottle 20 and it is also less expensive and less complex to manufacture.

The bottle of the invention may be provided with markings which indicate the volume of fluid therein. In bottle 20, for example, "milliliter" volume markings are provided on one side (see FIG. 6) and "ounce" volume markings are provided on the opposite side (see FIG. 7).

Baby feeding bottles in accordance with the present invention may be made from a variety of materials including, e.g., glass, and thermoplastic resins such as polypropylene, polystyrene and polycarbonate. Polycarbonate is preferred due to its clarity and durability. Various suitable polycarbonate resins are commercially available from General Electric under the tradename LEXAN.

Nursing bottles according to the present invention can be made most conveniently by extrusion blow molding techniques.

The wall thickness of bottles in accordance with the invention range from about 0.01 inch (0.254 mm) to about 0.04 inch (1.02 mm). The retaining collar, a well-known item for securing a nipple to the open end of a feeding bottle, may be suitably made from polypropylene.

Feeding nipples are also well known in the art; these can be made, e.g., from natural or silicone rubbers or the like materials.

Those skilled in the art will recognize that the teachings of the present invention may be utilized with a variety of nursing bottles. For example, in addition to the embodiments specifically illustrated herein, it is contemplated that the present invention may be embodied in inter alia baby bottles having curved shapes like that shown in U.S. Pat. No. 4,832,213; in baby bottles having a generally toroidal hollow chamber like that shown in U.S. Pat. No. 4,867,325; in bottles of the type disclosed in U.S. Pat. No. 4,813,556; and in the nursing bottle illustrated in U.S. Pat. No. Des. 316,754.

TABLE 2

| Classification | Brand | Maximum Volume, Ounces | Deliverable Volume, Ounces | Undeliverable Volume, Ounces | Maximum Volume Delivered, (%) |
|---|---|---|---|---|---|
| Cylindrical | Evenflo | 9.80 | 5.14 | 4.66 | 52% |
| Straight | Gerber | 10.73 | 5.14 | 5.59 | 48% |
| Grippable Straight | Ansa | 10.08 | 4.67 | 5.41 | 46% |
| Cylindrical | Cherubs Comfortflow | 10.11 | 7.72 | 2.39 | 76% |
| Angled | Control | 9.81 | 7.21 | 2.60 | 74% |
| Non-cylindrical | Betta Baby Bottle | 8.76 | 8.10 | 0.66 | 93% |
| angled | Evenflo Angled Nurser | 9.90 | 9.41 | 0.49 | 95% |
| Inventive | Gerber NUK Angled Nurser | 8.68 | 7.10 | 1.58 | 82% |
| Bottle | Bottle of FIGS. 1–12 | 10.24 | 8.71 | 1.53 | 85% |

NOTES:
Maximum Volume = volume in ounces, held by bottle in free standing position
Deliverable Volume = Maximum Volume–Undeliverable Volume
Undeliverable Volume = volume in ounces, which cannot be delivered from bottle when nipple is positioned horizontally
Maximum Volume Delivered, % = Deliverable Volume divided by Maximum Volume × 100

What is claimed is:

1. An infant's feeding bottle comprising a body portion having a closed end, a head portion having an open end, and a neck portion joining said head portion to said body portion, said neck portion having a cross-section, said cross section having a shape comprised of a central region having a width and a pair of transverse end regions, each of said transverse end regions having a width that is greater than the central region width, said central region comprised of two continuous arcuate lateral sides, said bottle comprising a front surface, a back surface, a first left side surface and a second side surface, said front and back surfaces being joined to each other by said first and second side surfaces, said front surface comprising a first depression and said rear surface comprising a second depression, wherein said first and second depressions are displaced longitudinally with respect to each other to form said shape.

2. An infant's feeding bottle comprising:

a body portion having a closed end, a head portion having an open end, and a neck portion joining said head portion to said body portion, said body portion having a longitudinally extending axis and said head portion having a longitudinally extending axis, said axes intersecting to define an angle, said bottle including a first plane passing through the longitudinally extending axis of said body portion and the longitudinally extending axis of said head portion, said bottle including a second plane passing through said longitudinally extending axis of said body portion and forming an angle of 90° with said first plane, said bottle including a first depression on one side of said second plane and a second depression on the side of said second plane opposite said one side, wherein said first and second depressions are displaced longitudinally with respect to each other.

3. An infant's feeding bottle according to claim 2 wherein said first depression is adapted to receive one or more of an infant's fingers during use.

4. An infant's feeding bottle according to claim 2 wherein said second depression is adapted to receive one or both of an infant's thumbs during use.

5. An infant's feeding bottle according to claim 2 wherein said bottle has an open end and a closed end, said first depression is located between said open end and said closed end, and said second depression is closer to said open end than is said first depression.

6. An infant's feeding bottle according to claim 2 wherein said first plane divides said first depression into a first portion and a second portion.

7. An infant's feeding bottle according to claim 6 wherein said first portion is a mirror image of said second portion.

8. An infant's feeding bottle according to claim 2 wherein said first plane divides said second depression into a first portion and a second portion.

9. An infant's feeding bottle according to claim 8 wherein said first portion is a mirror image of said second portion.

10. An infant's feeding bottle comprising a body portion having a closed end, a head portion having an open end, and a neck portion joining said head portion to said body portion, said bottle comprising a front surface, a back surface, a first left side surface and a second side surface, said front and back surfaces being joined to each other by said first and second side surfaces, said front surface comprising a first depression and said rear surface comprising a second depression, said first depression and said second depression are displaced longitudinally with respect to each other.

11. An infant's feeding bottle according to claim 10 wherein said first depression is adapted to receive one or more of an infant's fingers during use.

12. An infant's feeding bottle according to claim 10 wherein said second depression is adapted to receive one or both of an infant's thumbs during use.

13. An infant's feeding bottle according to claim 10 wherein said bottle has an open end and a closed end, said first depression is located between said open end and said closed end, and said second depression is closer to said open end than is said first depression.

14. An infant's feeding bottle according to claim 10 wherein said first plane divides said first depression into a first portion and a second portion.

15. An infant's feeding bottle according to claim 14 wherein said first portion is a mirror image of said second portion.

16. An infant's feeding bottle according to claim 10 wherein said first plane divides said second depression into a first portion and a second portion.

17. An infant's feeding bottle according to claim 16 wherein said first portion is a mirror image of said second portion.

18. An infant's feeding bottle comprising:

a body portion having a closed end;

a permanently fixed head portion having an open end, a longitudinally extending axis through said bottle, and a neck portion joining said head portion to said body portion and having a cross-section, said closed end having a thickness of about 0.01 inches to about 0.04 inches, said cross section having a shape comprised of a central region having a width and a pair of transverse end regions, each of said transverse end regions having a width that is greater than the central region width, said central region comprised of two continuous arcuate lateral sides that begin at a first transverse end region and terminate at a second transverse end region, said bottle including a first plane passing through the longitudinally extending axis of said bottle, said bottle including a second plane passing through said longitudinally extending axis of said bottle and forming an angle of 90° with said first plane, said second plane dividing said bottle into a front surface and a back surface, said bottle comprising a first left side surface and a second side surface, said front and back surfaces being joined to each other by said first and second side surfaces, said front surface comprising a first depression and said rear surface comprising a second depression, said first depression and said second depression are located at said neck portion and are displaced longitudinally with respect to each other.

* * * * *